United States Patent [19]

Hecker

[11] Patent Number: 5,005,611

[45] Date of Patent: Apr. 9, 1991

[54] APPARATUS FOR MODIFYING CABLES AND PRODUCTS THEREOF

[76] Inventor: Jack D. Hecker, 223 Johnson Dr., Duncanville, Tex. 75116

[21] Appl. No.: 432,558

[22] Filed: Nov. 6, 1989

[51] Int. Cl.[5] ..... B21F 1/02

[52] U.S. Cl. ..... 140/147; 29/749; 29/872; 174/117 F

[58] Field of Search ..... 29/749, 747, 872; 174/117 F, 113 R; 140/147, 149

[56] References Cited

U.S. PATENT DOCUMENTS

| | | | |
|---|---|---|---|
| 3,440,118 | 4/1969 | Obeda | 174/113 R X |
| 3,459,878 | 8/1969 | Gressitt et al. | 29/872 X |
| 3,609,216 | 9/1971 | Copp | 174/117 FF X |
| 3,671,366 | 6/1972 | Miller | 174/117 F X |
| 4,132,251 | 1/1979 | Folk et al. . | |
| 4,132,252 | 1/1979 | Shatto, Jr. . | |
| 4,455,818 | 6/1984 | Sugimoto et al. | 174/117 F X |
| 4,576,662 | 3/1986 | Lemke | 29/749 X |
| 4,614,028 | 9/1986 | Rich | 29/749 |
| 4,626,298 | 12/1986 | Allard | 174/117 F X |

FOREIGN PATENT DOCUMENTS

| | | | |
|---|---|---|---|
| 97414 | 1/1984 | European Pat. Off. | 174/117 F |
| 2210019 | 9/1974 | Fed. Rep. of Germany . | |
| 2758472 | 7/1979 | Fed. Rep. of Germany | 174/117 F |
| 2937689 | 6/1980 | Fed. Rep. of Germany | 29/749 |

*Primary Examiner*—Carl J. Arbes
*Attorney, Agent, or Firm*—Johnson & Gibbs

[57] ABSTRACT

An apparatus for separating and orienting conductors from a bundled array into a planar array includes a grooved template and means for fixedly uniting the conductors when disposed in the groove. A cable adapted for connection to a flat ribbon cable connector includes a portion of bundled connectors, and a portion including conductors separated by hand into the grooves on a template and fixedly retained in position by a laminate material connected thereto. The method involving use of the apparatus to produce the product described above is also disclosed and claimed.

6 Claims, 2 Drawing Sheets

APPARATUS FOR MODIFYING CABLES AND PRODUCTS THEREOF

BACKGROUND OF THE INVENTION

1. Field of the Invention

The present invention relates to electrical wiring products and manufacture thereof. More specifically, the present invention relates to apparatus for separating and orienting conductors from a bundled array into a planar array, the process of using such apparatus, and the products of such a process.

2. Description of Related Art

Mass termination, insulation displacement connectors have come into increasing commercial prominence because of the significant savings in time and labor they offer compared to stripping and individually terminating each conductor. A form of conductors that has come to be widely used with such connectors is flat cable. Flat cable comprises conductors running parallel and spaced, at least at some point, to match the spacing of terminal elements in the connector. Flat cable also generally comprises a layer of insulation that acts to hold the conductors in place.

A type of flat cable that has become widely used in applications that require insulation displacement contact (IDC) termination as well as mass termination in circuit board requirements is twisted flat ribbon cable. Twisted flat ribbon cable, as is well known to those skilled in the art, includes twisted pairs of wires having straight wire portions where the wires are disposed in a spaced, parallel relationship to allow connection to a connector. Twisted flat ribbon cable is presently manufactured with two inch, untwisted, flat portions every eighteen inches. Thus, as conveniently made and as is readily available, twisted flat ribbon cable can only be mass terminated at eighteen inch increments. Although it is possible to special order twisted flat ribbon cable of a nonstandard length, such special ordering is generally cost prohibitive unless an extremely large volume of nonstandard cable is ordered. Therefore, in all but very unusual situations, twisted pair flat cable is used in eighteen inch length increments.

Needless to say, being forced to use a popular cable in only certain lengths frequently results in waste and needless expense. For example, in a certain situation a twenty four inch length of twisted pair flat ribbon cable may be needed. As the cable may only be terminated in eighteen inch increments, unfortunately however, a thirty-six inch length of cable (i.e., two eighteen inch long portions) must be used. This results in twelve inches of wasted cable per use. In addition to adding unnecessary cost to units, such waste also results in bunching of excess cable (e.g., within a housing) that is unsightly at best, and possible hazardous.

Further with respect to background art relating to the present invention, it should be appreciated that while flat cables, such as twisted flat ribbon cable, offer many advantages with respect to efficiency in termination, they present difficulties during routing. Comparing flat ribbon cable to round cable, for example, the flat ribbon cable has certain dimensions larger than comparable round cables. Such larger dimensions can make flat ribbon cable less susceptible than round cable to routing in certain situations, e.g., through conduits. Additionally, flat ribbon cable is somewhat less flexible than comparable round cable, insofar as it resists bending in non-orthogonal directions.

There are a number of patents including teachings pertinent to the general background of the present invention. These patents include U.S. Pat. No. 4,125,137 to Shatto, Jr., U.S. Pat. No. 3,936,933 to Folk et al, U.S. Pat. No. 4,642,874 to Lkitenhizer, Jr., U.S. Pat. No. 4,767,891 to Biegon et al., and U.S. Pat. No. 4,486,253 to Gonia. Each of these patents is discussed briefly below.

U.S. Pat. No. 4,125,137 to Shatto, Jr. is directed to an apparatus for locating wires in a predetermined co-planar relationship to each other. Shatto, Jr. shows a template plate with a plurality of wire-receiving recesses 26, FIG. 1, and a roller 44 for pressing a plurality of wires 2, FIG. 2, in a predetermined spaced apart, coplanar relationship.

U.S. Pat. No. 3,936,933 to Folk et al. is directed to a method for positioning leading portions of individual wires of a plurality of wires in spaced-apart relationships with respect to each other and a template utilized in accomplishing the same. Folk et al. shows a planar groove template 12, FIG. 1, used with a compressive force applying roller element 24, for positioning the leading portion L of a plurality of wires W in a spaced-apart relationship in preparation for the application of an electrical connecting device using a suitable applicator mechanism A.

U.S. Pat. No. 4,642,874 to Litehizer, Jr. is directed to a hand-held tool for wire insertion. Litenhizer, Jr. shows a tooth indexing cartridge 100, FIG. 1, used with a tool assembly for inserting a plurality of conductors in a connector having a plurality of terminals.

U.S. Pat. No. 4,767,891 to Biegon et al. is directed to a mass terminable flat cable and cable assembly incorporating the cable. Biegon et al. show a cable section 70, FIG. 7, comprised of a plurality of loose twisted pairs of conductors 26A. At section 68, FIG. 4, the plurality of conductors 26A are held in regularly-spaced, parallel relationship by a carrier film 24A by means of the attachment layer 44A being fused with conductor jackets.

U.S. Pat. No. 4,486,253 to Gonia is directed to a method of making a multiconductor cable assembly. Gonia shows individual insulated conductors 22, 24, 26, 28 and 30, FIG. 4, bound in a compact profile in an intermediate portion 14, FIG 1, and also at an end portion 18 in which the individual insulated conductors are not secured together. The conductors 22, 24, 26, 38 and 39, FIG. 1, are also shown arranged and bonded together in a side by side contiguous relationship along a portion of their mutual lengths at portion 12. The conductors are bonded together using a jig 42, FIG. 5.

In addition to the above-identified and described patents, there are a multitude of other patents and teaching relating to round and flat cables, apparatus for making such cables, and the processes used by the various apparatus in making such cables. Notwithstanding the voluminous teachings of the prior art, there is nowhere disclosed or suggested a simple, relatively inexpensive apparatus for quickly and easily producing wire perfectly suitable for any individual IDC mass termination application. This is a shortcoming and deficiency of the prior art. Further, related shortcomings and deficiencies of the prior art relate to the absence of cables manufactured by such a simple, relatively inexpensive apparatus and to the absence of teachings of a process effected by such an apparatus.

SUMMARY OF THE INVENTION

The present invention overcomes the shortcomings and deficiencies of the prior art by providing an apparatus for separating and orienting conductors from a bundled array into a planar array. According to the teachings of the present invention, the apparatus for separating and orienting conductors from a bundled array into a planar array includes a grooved template and means for fixedly uniting the conductors when disposed in the grooves.

Certain embodiments of the separating and orienting apparatus of the present invention also include means for facilitating retainment of the individual conductors in the grooves. According to the teachings of the present invention, such means for facilitating retainment of the individual conductors in the grooves may include teeth projecting up away from and surrounding the grooves.

In embodiments of the apparatus of the present invention, means for facilitating retainment of the individual conductors in the grooves may include notched walls at the ends of the grooves, which notches may be aligned with the grooves.

According to the teachings of the present invention, the means for fixedly uniting the conductors when disposed in the grooves may include a press plate. This press plate may be a heatable press plate especially suitable for affixing a laminate material to the conductors disposed in the grooves.

Further, according to the teachings of the present invention, the means for fixedly uniting conductors when disposed in the grooves may also include means for controlling the temperature attained by the heatable press plate.

Apparatus according to the teachings of the present invention may include means for holding a bundled array cable in place, the conductors of which bundled array are to be separated into grooves in a die. Further, according to the teachings of the present invention, the means for holding a bundled array cable in place may include a cable clamp, which cable clamp may have a plurality of grooves thereon, which plurality of grooves being of different sizes so as to conveniently accommodate different sizes of cables. A cable adapted for connection to a flat ribbon cable connector may include a portion of bundled conductors and a portion of conductors separated by hand into a grooved template, which separated conductors are fixedly retained in position by a laminate material connected thereto.

The present invention also encompasses a cable which includes an appropriate number of conductors appropriately spaced to allow connection of a conventional twisted pair flat ribbon cable connector thereto.

Still further, the present invention teaches a method of separating and orienting conductors from a bundled array into a planar array which includes the steps of fixedly positioning a portion of a bundled array, separating the conductors on one side of the fixed portion and fixedly positioning the separated conductors. The step of separating the conductors on one side of the fixed portion may include the step of disposing the conductors in grooves.

In embodiments of the method of the present invention, the step of separating the conductors on one side of a fixed portion further includes the step of inserting the conductors in at least one notch. The step of inserting the conductors in at least one notch may involve inserting the conductors in two notches, one notch on each end of a groove.

According to the teachings of the present invention, the step of fixedly positioning the separated conductors may include the step of exerting pressure on a material disposed on the separated conductors. This step of fixedly positioning the separated conductors may also include the step of heating the material (e.g., a laminate material) disposed on the separated conductors.

According, it is an object of the present invention to provide an apparatus for making a substitute cable for twisted flat ribbon cable, which substitute cable is more flexible and less expensive than twisted flat cable.

Another object of the present invention is to provide a round cable modifying apparatus that is portable, inexpensive to maintain and operate, and easy to use.

Yet another object of the present invention is to provide a process for making a valuable product quickly, easily, and inexpensively.

Still yet another object of the present invention is to provide an apparatus for making a cable having a perfect length for any application in which flat ribbon type cable connectors are employed.

BRIEF DESCRIPTION OF THE DRAWINGS

For a more complete understanding of the present invention, and for further objects and advantages thereof, reference may now be had to the following description taken in conjunction with the accompanying drawings in which.

DETAILED DESCRIPTION OF THE INVENTION

Figure 1:
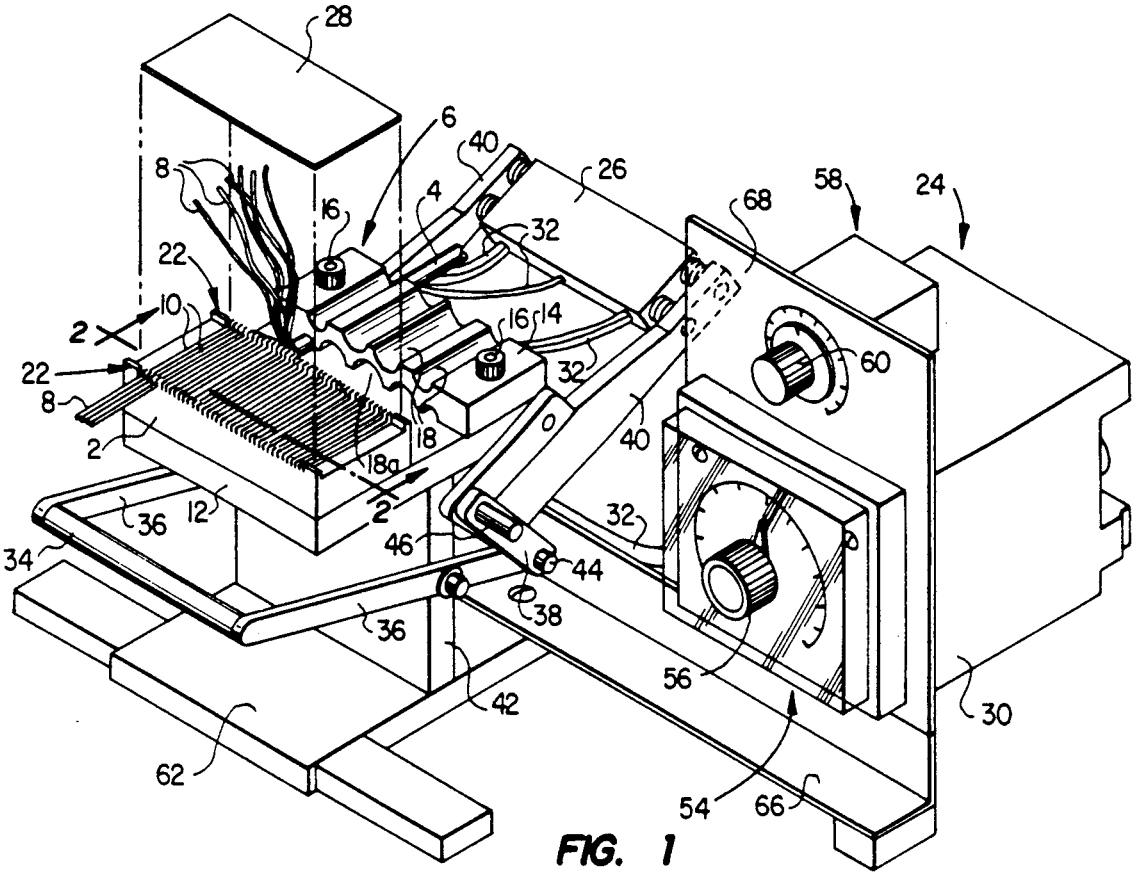
FIG. 1 is a perspective view of an apparatus according to the teachings of the present invention, which apparatus may be employed to separate and orient conductors from a bundled array into a planar array.

Referring now to the drawings wherein like reference numerals designate identical or similar elements throughout the several views, depicted in FIg. 1 is a perspective view of an embodiment of an apparatus according to the teachings of the present invention. In very broad terms, the apparatus shown in FIG. 1 comprises means for holding separated conductors in a planar array and means for fixedly uniting the conductors so separated. Both of these two generally identified means are discussed in greater detail below.

First, with regard to the means for holding separated conductors in a planar array, the shown elements forming this means include grooved template block 2. Noting that a portion of a bundled array of conductors 4 (appropriately jacketed) is shown in FIg. 1 held by a cable 6, and further noting that the jacket is removed from one end of cable 4 to reveal individual conductors 8 to be separated, it should be appreciated that laying of each individual conductor in a groove 10 or portion 2 effects separation of the conductors 8.

Certain aspects of the above-described elements are particularly noteworthy. First, it should be noted that for compactness and convenience both the cable clamp 6 and grooved template or die 2 share a common support structure 12. With respect to this common support structure, clamp 6 comprises a clamp top 14 and means 16 for attaching and detaching this top 14 to support structure 12 so that a bundled array or round cable 4 can be clamped therebetween. In FIG. 1 this means 16 may be seen to consist of two screws that can be screwed by hand or otherwise into or out of threaded voids in support structure 12. Grooved template block 2 is shown as a solid block with parallel grooves 10 across its top, which block (in the shown embodiment) is welded to support structure 12.

Figure 3:
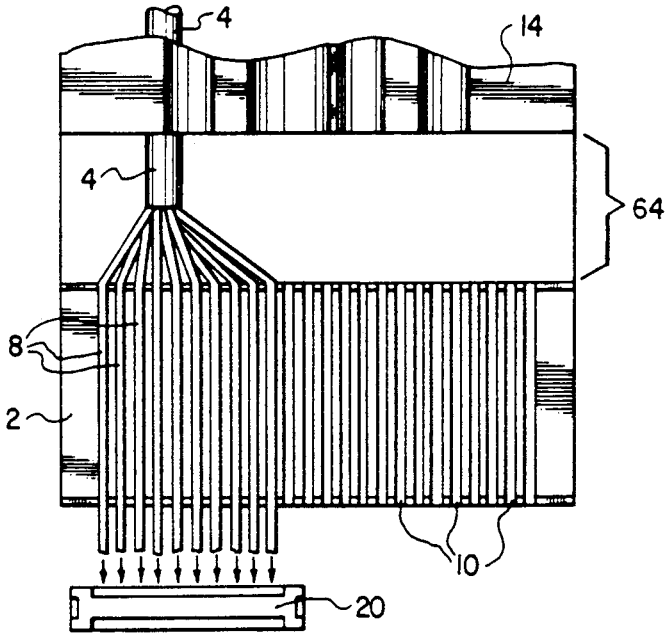
FIG. 3 is a top plane view of a portion of the apparatus shown in FIG. 1 and also a view of a connector that could be connected to a cable processes by the apparatus and method of the present invention.

With special regard to clamp 6, a noteworthy aspect of this element is that it has a number of grooves 18 on its surface, which grooves facilitate its engagement of various different sized cables. Most usefully, these grooves could be sized so as to facilitate engagement of cables most likely to be altered by the apparatus of the present invention. Such cables likely include 60 wires or 30 pair cables, 50 wires or 25 pair cables, 40 wires or 20 pair cables, 26 wires or 13 pair cables, and 20 wires or 10 pair cables. In preferred embodiments of the present invention, complex interrelationships may exist between the various grooves 18. For example, in most situations it is desirable that the center of planar array emanating from a bundled array be aligned with the longitudinal center axis of the bundled array. Therefore, the largest groove (groove 18A in FIG. 1) would ideally be centrally located on cable top 14 and of such size that a planar array of conductors filling every groove 10 in block 2 would, in bundled form, fit snugly in groove 18A. Other grooves 18 could be so sized that if an array were started in a far end groove 10 and continued across grooves 10, it would result in an array centered with respect to the bundled array from which it emanated, notwithstanding the fact that the cable is held off center, that is from groove 18A, by clamp top 14. Of course, planar arrays centered with respect to the apparatus of the present invention (e.g., the array depicted in FIG. 3 is not so centered), but the apparatus of the present invention, in a preferred form, could facilitate such results.

Figure 2:
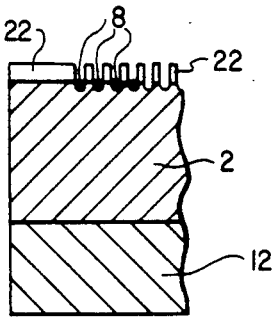
FIG. 2 is a cross sectional view taken along line 2—2 in FIG. 1.

Block or die 2 also has a number of noteworthy aspects. First, the grooves 10 thereacross should be sized and spaced to receive conductors in a manner that allows easy connection of a selected connector. As previously mentioned, it is very desirable to be able to connect a flat ribbon type connector 20 to a cable 4, and this type of connector 20, well known to those skilled in the art, is depicted in FIG. 3. Second, to facilitate the holding of conductors in grooves 10, block 2 has teeth or notch portions generally designated by reference numeral 22. In FIG. 1, this element 22 more specifically comprises two walls, one wall at each end of the various grooves 10, both of which walls have a plurality of notches therein, which notches are aligned with the various grooves 10. This structure is more clearly shown in FIG. 2. An embodiment of the present invention has been constructed and it has been found that such notches can be very effectively hold conductors run into and through the various grooves 10. This combined groove/notch structure is important in that it is both effective and simple to make.

As previously mentioned, the apparatus according to the teachings of the present invention also includes means for fixedly uniting the separated conductors. In general terms, referring to FIg. 1, this means comprises a heating unit 24, including a heating press 26 and various heater control mechanisms.

In the preferred embodiment of the invention shown in the drawings, the various separated conductors are fixed in position by the attachment of laminate material thereto. Continuing to refer to FIG. 1, such a piece of laminate material is shown as element 28. Once all of the wires are satisfactorily positioned in the various grooves, laminate material 28 may be laid on top of the separated conductors, in a position where heating press 26 can both exert downward pressure on it and heat it to effect a complete lamination process.

Heating press 26, in the preferred embodiment shown in the FIGS., is formed of oil hardened tool steel having approximate dimensions of 3½ inches by 1½ inches by ½ inch. Formed of such material with such a size, heating press 26 is ideally suited to transfer heat to the laminate material 28 as generally described above. Such heat can be generated by use of a cartridge or similar type heater 30, connected to heating press 26 by conventional conductors 32.

The preferred embodiment of the invention shown in the FIGS. also has a unique mechanism for lowering the heating press 26 onto laminated material 28 that may be disposed on separated conductors 8. This mechanism comprises a handle 34, two handle levers 36, two intermediate levers 38 (only one of which can be seen in FIG. 1), and two press arm elements 40, connected as is most clearly shown in FIG. 1. In general, it may be seen that the two handle levers 36 are disposed around so as to hold handle 34 as the two press arm elements 40 are disposed around so as to hold heating press 26. The handle levers 36 are both pivotally attached to an upstanding support 42 of support structure 12, and the press arm elements 40 are similarly mounted to support structure 12. The two intermediate levers 38 are pivotally connected to opposing sets of a handle lever 36 and a press arm element 40, the connections being effected by axle elements 44, 46 that extend through and interconnect both groups of a handle lever 36, intermediate lever 38, and press arm element 40. Importantly, for reasons that will become apparent based upon further discussion below, a portion of axle element 46 extends beyond its grouping of a handle lever 36, intermediate level 38 and press arm element 40 to provide a means for a person to easily exert pressure on the intermediate level 38.

Figure 4:
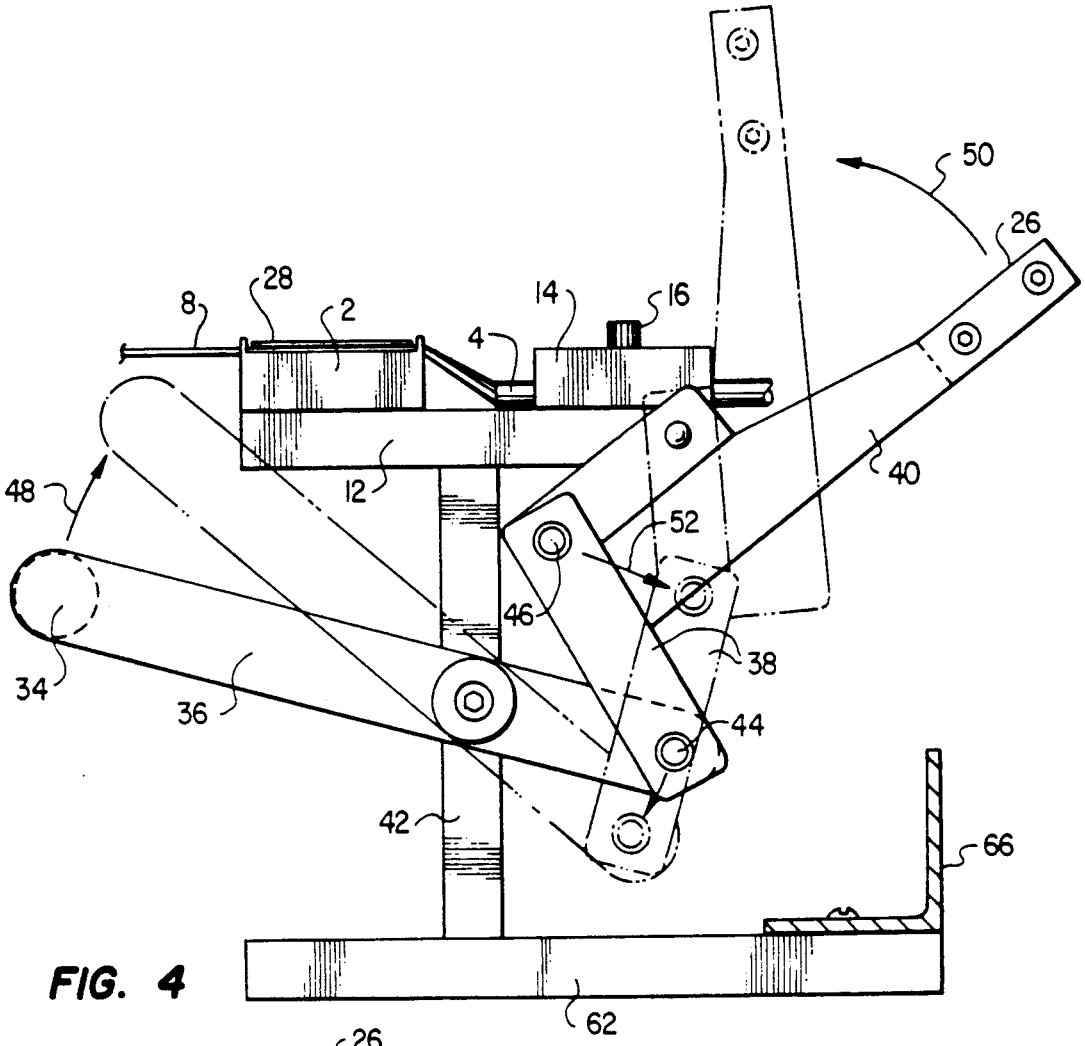
FIG. 4 is a side view of a portion of the apparatus shown in FIG. 1 showing a partial range of movement of portions of the apparatus.
Figure 5:
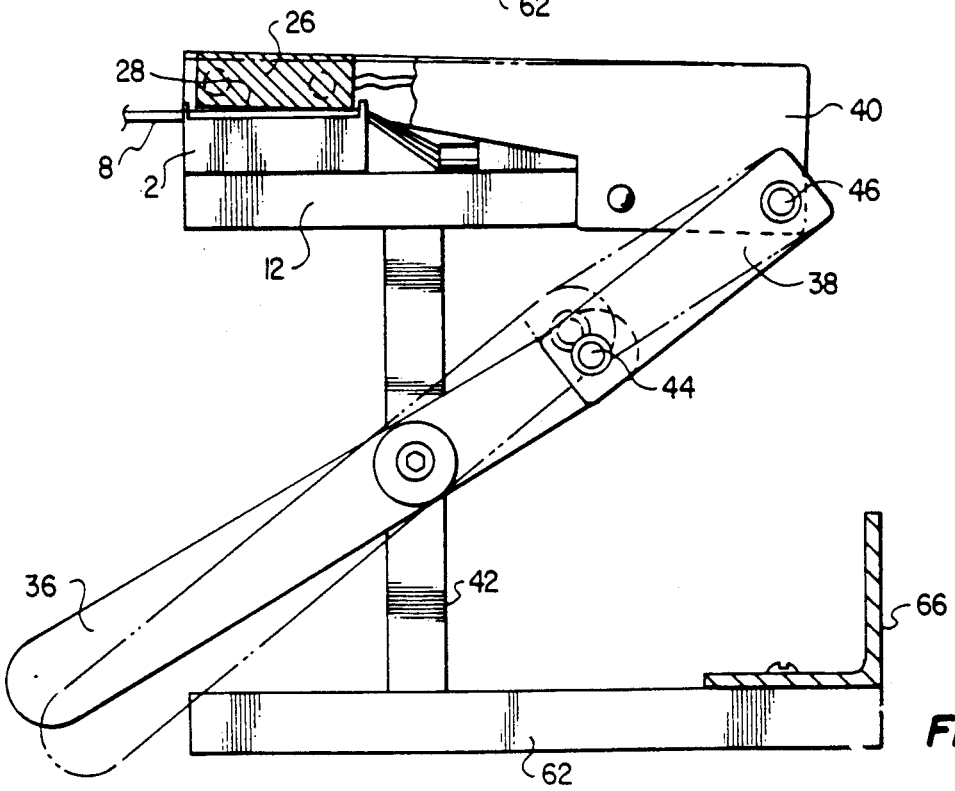
FIG. 5 is a side view as per FIG. 4, showing a different partial range of movement of portions of the apparatus.

Referring now to FIGS. 4 and 5, the interplay of the various elements which cause movement of the positioning of the heating press 26 are shown in greater detail. In FIG. 4, the position of the various elements when the heating press 26 is in the resting position away from laminate material 28 is shown by the solid lines. From that position, in order to move the heating press 26 into the heating position on top of a piece of laminate material 28, an apparatus user must first raise the handle 34 up to the position shown in phantom. This movement is indicated by arrow 48. That movement, because of interplay between the various arms and levers of the heating press moving mechanism, causes the heating press 26 and heating press arms to begin moving the direction indicated by arrow 50. However, raising of the handle 34 as described above is not sufficient in and of itself to allow the heating press 26 to drop onto laminate material 28. This is because, as the linkage is set up, the heating press 26 is positioned over center even after complete raising of the handle 34. It is necessary, therefore, in order to lower the heating press 26 onto the laminate material 28 to also push the axle 46 in the direction indicated by arrow 52. Doing that in conjunction with raising of the handle 34 allows the heating press 26 to drop onto laminate material 28 placed on the separated conductors 8. It should be appreciated that simultaneous or near simultaneous raising of the handle 34 and exertion of pressure on the projecting axle 46 requires two hands, which ensures operator desire to effect the movement. Such two hand operation also ensures full operator attention, which enhances apparatus safety.

Referring now to FIG. 5, it should be appreciated that the various elements in the apparatus come to rest naturally in the position illustrated by the solid lines when the heating press 26 drops down on laminate 28. At that point, however, because of the sizing and other interplay factors governing the various elements, the linkage may be locked into position by raising up of the linkage to the position shown by the phantom lines in FIG. 5. This locking is both a safety feature and an aspect of the illustrated preferred embodiment that ensures uniform heating and exertion of pressure by the heating press 26 on the laminate material 28 and separated conductors 8.

Referring now again to FIG. 1, it may be seen that the heating unit also includes various heater control mechanisms, such as a temperature selector portion 54 (with control knob 56) and timer 58 (with control knob 60). The temperature selector 54 and timer 58 can be set in order to precisely control the heating of laminate material 28 to effect the desired degree of affixation of the laminate material 28 to the separated conductors 8.

In operation, a user of the apparatus according to the present invention effects modification of a bundled array of conductors as follows. First, one end of a bundled array 4 is stripped. The bundled array is then positioned in the clamp portion 6 of the apparatus so that the stripped conductors 8 project towards the grooved block 2. The apparatus user then individually positions the conductors in grooves 10 in a desired final planar configuration. The notches 22 hold positioned conductors 8 in place in the grooves 10 while subsequent conductors are so disposed, until this step is completed. Next, a piece of laminate material 28 is then disposed on top of the separated conductors 8, the heating press 26 is moved into the heating position and locked as described above, and a predetermined amount of heat is applied to effect lamination. At this point, the conductors 8 can be removed from the grooves 10 and they will remain fixed in the desired planar configuration and a planar type connector 20 can be connected to the ends of the conductors. Of course, this operation can be repeated at the other end of a length of bundled conductors 4 so that a final product is effectively a bundled array transformed into a planar array at each end with appropriate planar type connectors 20 affixed thereto.

An apparatus according to the teachings of the present invention has actually been constructed and tested with outstanding results. By way of example only, various characteristics of this actually constructed model are set forth below:

BILL OF MATERIAL

| ELEMENT | DESCRIPTION |
|---|---|
| Base (62 in FIGS. 1, 4 and 5) | 4" wide × 6" long × ½" high; cold drawn steel |
| Upright Support 42 | 3½" wide × 4" long × ¾" thick; cold drawn steel |
| Laminator Base 12 | 3½" wide × 4" long × ½" thick; cold drawn steel |
| Cable to Combing Spacer (64 in FIG. 3) | 3½" wide × 4" long × ⅛" thick; cold drawn steel |
| Comb or Grooved Template Block 2 | 3½" wide × 1½" long × ½; oil hardened tool steel |
| Cable Clamp 14 | 3½" wide × 1½" long × ½ thick; cold drawn steel |
| Handle Lever 36 | ¾" wide × 5¼" long × ¼" thick; cold drawn steel |
| Handle 34 | ½" round × 4" long; cold drawn steel |
| Intermediate Lever 38 | ¾" wide × 2¾" long × ¼" thick; cold drawn steel |
| Press Arm 40 | 1¾" wide × 5½" long × ¼" thick; cold drawn steel |
| Heating Press 26 | 3½" wide × 1½" long × ½"; oil hardened tool steel |
| Heat Control Bracket (66 in FIG. 1) | 12" × 1½" × 1½"; cold drawn angle iron |
| Control Bracket (68 in FIG. 1; although shown with larger dimensions than indicated to accommodate timer 58) | 4" wide × 5" long × ⅛" thick; cold drawn steel |
| Heat Controller 54 | Extech Instruments Model J (IC) |

In the actually constructed embodiment of the present invention, the foregoing elements were welded together as appropriate for durability. Other noteworthy aspects of the actually constructed model of the present invention include:

Portability

Bench Model Function

110 Volt Operation

Weight of about 15 pounds

Exact wire centering at 0.050" ± zero

Adjustable temperature range from 0–600 degrees F.

Laminated strain relief areas can be from 0–1" long

Laminated strain relief can be as close as ⅝" and as far as 2" from the end of the cable Cables lengths can range from 1 foot to thousands of feet Lamination can be from 2 wires (one pair) through 64 wires (32 pairs) with no tooling change Cable centering is built into the clamp, allowing the laminated area to be centered to the cable: however, the cable can be placed on either side for special applications, with no tooling change Pinning configurations are not limited to pinning one-to-one. Wires can be laminated in any pattern for variable pinning, (i.e, pin 1 to pin 37 . . . pin 4 to pin 56, etc.)

Multiple IDCs can be applied to one or both ends, (i.e. a 60 conductor cable may be assembled with one 60 pin IDC at one end of two 30 pin connectors on the other end)

The "over center" heat press requires both hands to move the press into laminating position, an automatic built-in safety feature The lock position of the press allows for perfect alignment and pressure during actual lamination Wearing and misalignment of parts is eliminated by the maximum of five movement points Replacement parts are limited to three: (1) heating press; (2) combing (or laminating) area; and (3) cable clamp Chrome finish Based on the foregoing, it should be appreciated that the above-described tool is portable, inexpensive to maintain and easy to operate. It should also be appreciated that round cable modified by the above-described tool is a relatively inexpensive and improved substitute for flat ribbon cable. The preferred embodiment of the present invention described herein also has a number of noteworthy safety features, including its two hand required linkage mechanism and various heater controls.

It is thus believed that the operation and construction of the present invention will be apparent from the foregoing description. While the method and process and product described and shown have been characterized as being preferred, it will be obvious that various changes and modifications may be made therein without departing from the spirit and scope of the invention. For example, a tool could be provided for facilitating disposing conductors in grooves. Replaceable groove blocks could be made available, these blocks having different sized grooves to accommodate different sized conductors. Means, such as clamps, could be incorporated into or provided with the apparatus to allow it to be mounted to a bench. Other modifications and variations are possible. Accordingly, within the scope of the appended claims, the invention may be practiced otherwise than as specifically described herein.

What is claimed is:

1. A hand operated apparatus for modifying a round cable having a plurality of conductors so that said round cable is provided with a flat end portion to which a flat cable type conductor may be attached, said apparatus comprising:

a grooved template, said grooves designed to receive individual conductors; and means for fixedly uniting said conductors when disposed in said groove, said means for fixedly uniting said conductors when in said grooves comprising:

a press plate; and a hand operated toggle arm mechanism on which said press plate is mounted.

2. An apparatus as recited in claim 1, wherein said press plate is a heatable press plate especially suitable for attaching a laminate material to said conductors disposed in said grooves.

3. An apparatus as recited in claim 2, wherein said means for fixedly uniting conductors when disposed in said grooves further comprises means for controlling the temperature attained by said heatable press plate.

4. An apparatus as recited in claim 3, further comprising means for holding a bundled array cable in place, the conductors of which bundled array are to be separated into said grooves.

5. An apparatus as recited in claim 4, wherein said means for holding a bundled array cable in place comprises a cable clamp.

6. An apparatus as recited in claim 5, wherein said cable clamp has a plurality of grooves thereon, which plurality of grooves are of different sizes so as to conveniently accommodate different sizes of cables.

* * * * *